United States Patent [19]

Lefebvre

[11] Patent Number: 4,643,672

[45] Date of Patent: Feb. 17, 1987

[54] FLAME RETENTION HEAD ASSEMBLY FOR FUEL BURNERS

[75] Inventor: Denis Lefebvre, Blainville, Canada

[73] Assignee: Loudenco Ltd, Montreal, Canada

[21] Appl. No.: 803,802

[22] Filed: Dec. 2, 1985

[30] Foreign Application Priority Data

Mar. 28, 1985 [CA] Canada ..... 477754

[51] Int. Cl.[4] ..... F23Q 3/00

[52] U.S. Cl. ..... 431/265; 431/183; 431/352; 239/405

[58] Field of Search ..... 431/265, 350, 351, 352, 431/183; 239/405

[56] References Cited

U.S. PATENT DOCUMENTS

| | | | |
|---|---|---|---|
| 3,049,085 | 8/1962 | Musat et al. | 431/183 |
| 4,082,495 | 4/1978 | Lefebvre | 239/406 |
| 4,472,136 | 9/1984 | Lefebvre | 431/166 |

*Primary Examiner*—Carroll B. Dority, Jr.

*Attorney, Agent, or Firm*—Robic, Robic & Associates

[57] ABSTRACT

A flame retention head assembly for use in a fuel burner having a fuel nozzle mounted coaxially within an air pipe. This assembly comprises a continuously contoured, outwardly diverging flame retention head mounted concentrically within the air pipe in front of the fuel nozzle. This head successively defines, starting from its inlet end: an air-and-fuel mixture chamber; a first expansion chamber; a throttle and a second expansion chamber. A spinner plate is mounted transversely across the inlet end of the head. This plate comprises a central ring provided with a central hole having a diameter substantially identical to the one of the fuel nozzle, and a plurality of blades regularly distributed around the ring to cause air to enter and swirl into the mixture chamber. A round-shaped deflector is also mounted concentrically transversely within the retention head, to cause the air and fuel entering the head through its inlet end to stay longer within the first or second expansion chamber. The second expansion chamber is provided with circumferentially spaced air apertures to allow air to pass into the retention head to sustain combustion therein.

22 Claims, 8 Drawing Figures

FIG. 2
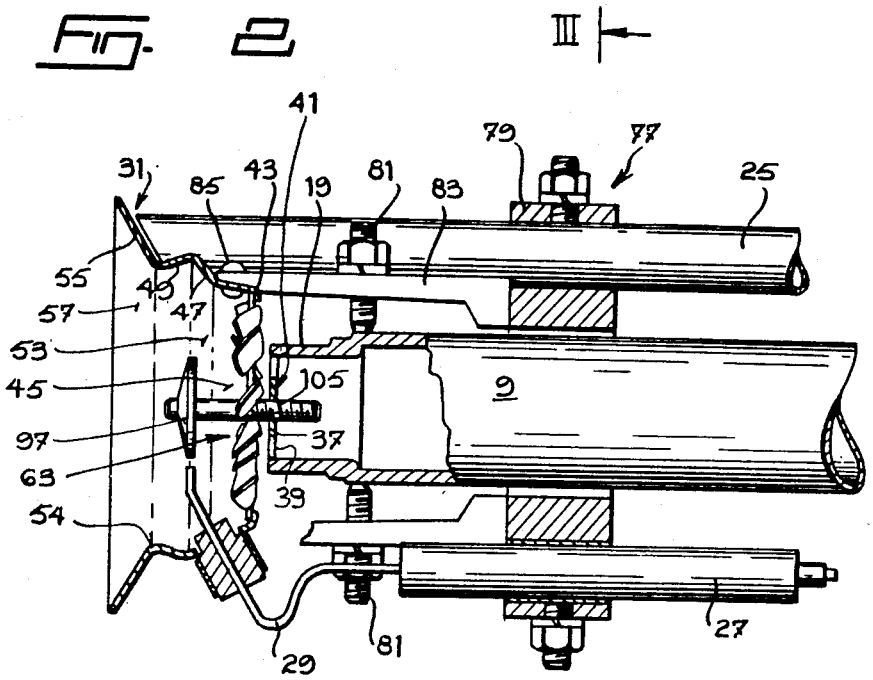
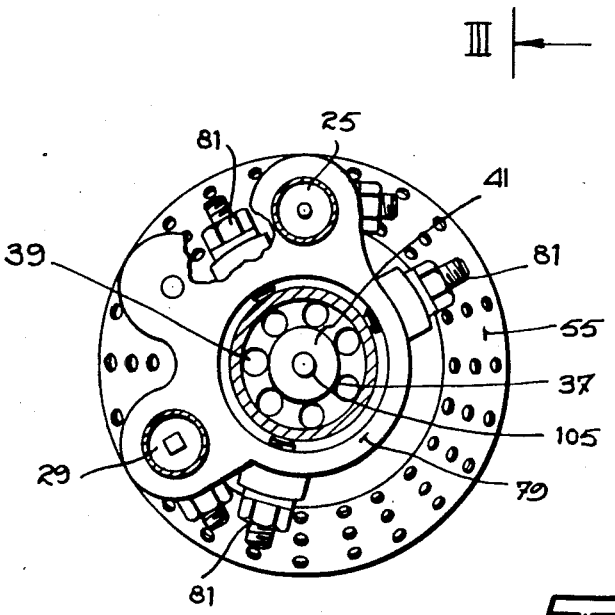
FIG. 3

Fig. 7
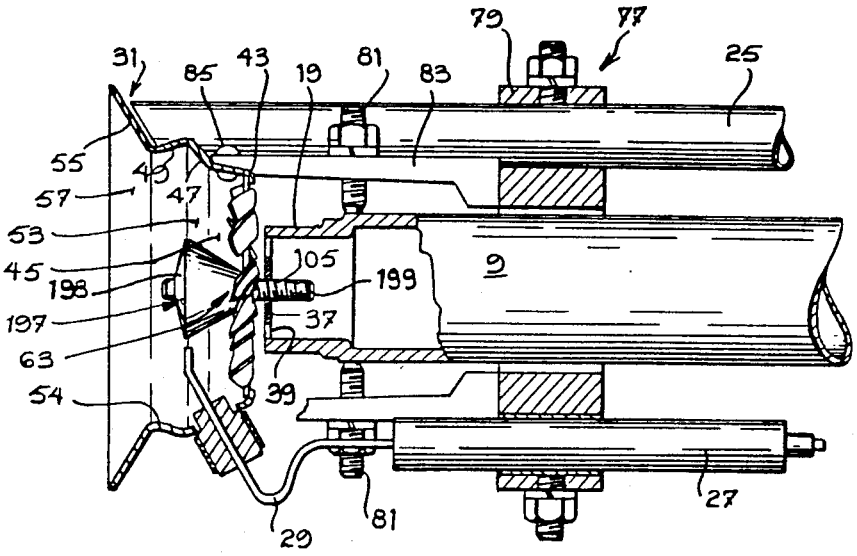
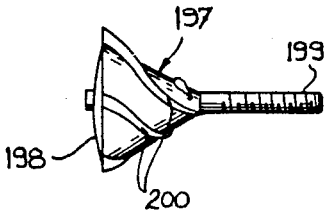
Fig. 8

FLAME RETENTION HEAD ASSEMBLY FOR FUEL BURNERS

The present invention relates to a flame retention head assembly for fuel burners of the gas or oil type, and to a fuel burner including such a flame retention head assembly. The invention more particularly relates to an improvement to the flame retention head assemblies and burners already disclosed and claimed in U.S. Pat. Nos. 3,733,169 of May 15, 1973, and 4,082,495 of Apr. 4, 1978, and in U.S patent application Ser. No. 538,269 filed on Oct. 3, 1983, now U.S. Pat. No. 4,472,136, all in the name of the present inventor.

In the type of burners with which the present invention is concerned, it is important to provide for an intimate mixture of air and fuel in such a way that combustion thereof is confined in the burner head rather than taking place in a separate combustion chamber forming part of a furnace, for instance. This is achieved by using a flame retention head secured to the fuel burner within the air supply pipe. Such a head makes it possible to better control and sustain the combustion reaction.

While the flame retention heads described in the above listed patents and more particularly the one described in the copending patent application have proved to be quite successful, it has now been found that appreciable improvement is obtained in terms of much greater combustion efficiency and more adequate flame pattern control when use is made of a round-shaped deflector mounted transversally concentrically within a continuously contoured, outwardly diverging retention head including a fuel and air mixture chamber, a first expansion chamber and a second expansion chamber following one another, to cause the air-and-fuel mixture entering the head to stay longer within the first or second expansion chamber.

In this improved flame retention head assembly, air and fuel are mixed in the mixture chamber. A first expansion of the mixture occur in a first, outwardly flaring expansion chamber. The flame is thereafter compressed in a throttle defined by an inwardly flaring wall before it is allowed again to expand in a second outwardly flaring, expansion chamber following immediately the throttle. Contrary to the retention heads disclosed in the above listed patents and patent application, air to sustain combustion and cool the head is admitted only into the second expansion chamber.

It is believed that the greater combustion efficiency as well as the more adequate flame pattern control are due both to the improved mixing that occur within the mixture chamber thanks to the deflector, and to the flame compression that occurs between the two expansion stages and allows to convert the static energy of air and gaseous fuel into kinetic energy, thus favorizing a more homogeneous mixture.

More specifically, and in accordance with the broad concept of the invention, there is provided an improved flame retention head assembly for use in a fuel burner having a fuel nozzle mounted coaxially within an air pipe, which improved assembly comprises:

(a) a continuously contoured, outwardly diverging retention head adapted to be mounted concentrically within the air pipe in front of the fuel nozzle, this retention head comprising a substantially cylindrical section having a diameter greater than the diameter of the fuel nozzle, and an inlet end intended to be located at a short distance ahead of the fuel nozzle, this cylindrical section defining an air-and-fuel mixture chamber;

a first outwardly flaring section continuously extending the cylindrical section, said outwardly flaring section defining a first expansion chamber;

an inwardly flaring section continuously extending the first outwardly flaring section, said inwardly flaring section defining a throttle with a diameter greater than the diameter of the cylindrical section, downstream the first expansion chamber; and a second outwardly flaring section continuously extending the inwardly flaring section, this second outwardly flaring section defining a second expansion chamber;

(b) a spinner plate mounted transversally across the inlet end of the cylindrical section of the retention head, this spinner plate defining a primary air inlet and comprising:

a central ring provided with a central hole, which central hole has a diameter substantially identical to the diameter of the fuel nozzle; and a plurality of blades regularly distributed around the ring to cause air to enter and swirl into the mixture chamber through the annular space defined between the peripheries of the fuel nozzle and the cylindrical section of the retention head respectively, such swirling air mixing within the mixture chamber with the fuel discharged therein by the fuel nozzle through the central hole of the spinner-plate;

(c) a plurality of circumferentially-spaced, air apertures provided through the second outwardly flaring section of the retention head, these apertures being intended to be in communication with the air pipe to allow air to pass into the second expansion chamber to sustain combustion therein; and (d) a round-shaped deflector mounted concentrically within the retention head, this deflector extending transversally across the retention head to cause the air and fuel entering this head through the inlet end of the cylindrical section to stay longer within the first expansion chamber and to recirculate downstream the deflector into the second expansion chamber.

According to a first preferred embodiment of the invention, the round-shaped deflector is a disc mounted within the retention head so as to transversally extend across said head substantially in the plane from which extends the inwardly flaring section. Due to its central position and its particular shape, this disc abruptly "stops" the fuel outcoming from the fuel nozzle and deflects it back to the combustion and first expansion chambers, thereby causing greater turbulences inside said first expansion chamber and substantially improved mingling of the fuel with the tubulent air coming through the spinner plate.

According to a second preferred embodiment of the invention, the round-spahed deflector is a cone coaxially mounted within the retention head, this cone having its base transversally extending across the head substantially in the plane from which extends the inwardly flaring section end its tip extending upstream close to the center of the spinner plate. Due to its particular position this cone cooperates with the inwardly flaring section to form a Venturi wherein the mixture of air and fuel formed in the mixture and first expansion chambers is first accelerated and subsequently deflected with great turbulences into the second expansion chamber downstream the base of the cone.

In both cases, the efficiency of the had assembly is substantially improved, due to the improved mixing and mingling that occurs in the various successive chambers.

In accordance with the invention, there is also provided a fuel burner assembly comprising:

(a) an air pipe having an inlet end intended to be connected to an air supply, and an outlet end;

(b) a fuel burner comprising a fuel nozzle having an inlet end intended to be connected to a fuel supply and an outlet end, and means for mounting this nozzle concentrically within the air pipe, close to its outlet end;

(c) a continuously contoured outwardly diverging retention head and means for mounting this retention head concentrically within the air pipe in front of the air nozzle, this retention head comprising:

a substantially cylindrical section having a diameter greater than the diameter of the fuel nozzle, and an inlet end located at a short distance ahead of the fuel nozzle, said cylindrical section defining an air-and-fuel mixture chamber;

a first outwardly flaring section continuously extending the cylindrical section, said outwardly flaring section defining a first expansion chamber;

an inwardly flaring section continuously extending the first outwardly flaring section, said inwardly flaring section defining a throttle with a diameter greater than the diameter of the cylindrical section, downstream the first expansion chamber; and a second outwardly flaring section continuously extending the inwardly flaring section, said second outwardly flaring section being parabolic in cross-section and defining a second expansion chamber;

(d) a spinner plate mounted transversaly across the inlet end of the cylindrical section of the retention head, this spinner plate defining a primary air inlet and comprising:

a central ring provided with a central hole, this central hole having a diameter substantially identical to the diameter of the fuel nozzle; and a plurality of blades regularly distributed around the ring to cause air to enter and swirl into the mixture chamber through the annular space defined between the peripheries of the fuel nozzle and the cylindrical section of the retention head respectively, this swirling air mixing within the mixture chamber with the fuel discharged therein by the fuel nozzle through the central hole of the spinner-plate;

(e) a plurality of circumferentially-spaced, air apertures provided through the second outwardly flaring section of the retention head, these apertures being in direct communication with the air pipe so as to allow air to pass into the second combustion chamber to sustain combustion therein; and (f) a disc or cone-shaped deflector mounted concentrically within the retention head, this deflector extending transversally across the retention head to cause the air and fuel entering this head through the inlet end of the cylindrical section, to stay longer within the first or second expansion chamber.

The invention and its various advantages will be better understood upon reading of the following non-restrictive description of three preferred embodiments thereof, made with reference to the accompanying drawings in which:

FIG. 2 is a longitudinal cross-sectional view of the nozzle end of the burner assembly of FIG. 1, shown on a larger scale, with the catalytic screen removed;

FIG. 3 is a cross-sectional view along line III—III of FIG. 2;

FIG. 7 is a longitudinal cross-sectional view of the nozzle end of a third burner assembly according to the invention, which assembly is similar to the one shown in FIGS. 1 to 3 except that is incorporates a cone-shaped deflector; and FIG. 8 is a side elevational view of another kind of cone-shaped deflector that can be used in the burner assembly of FIG. 7.

Figure 1:
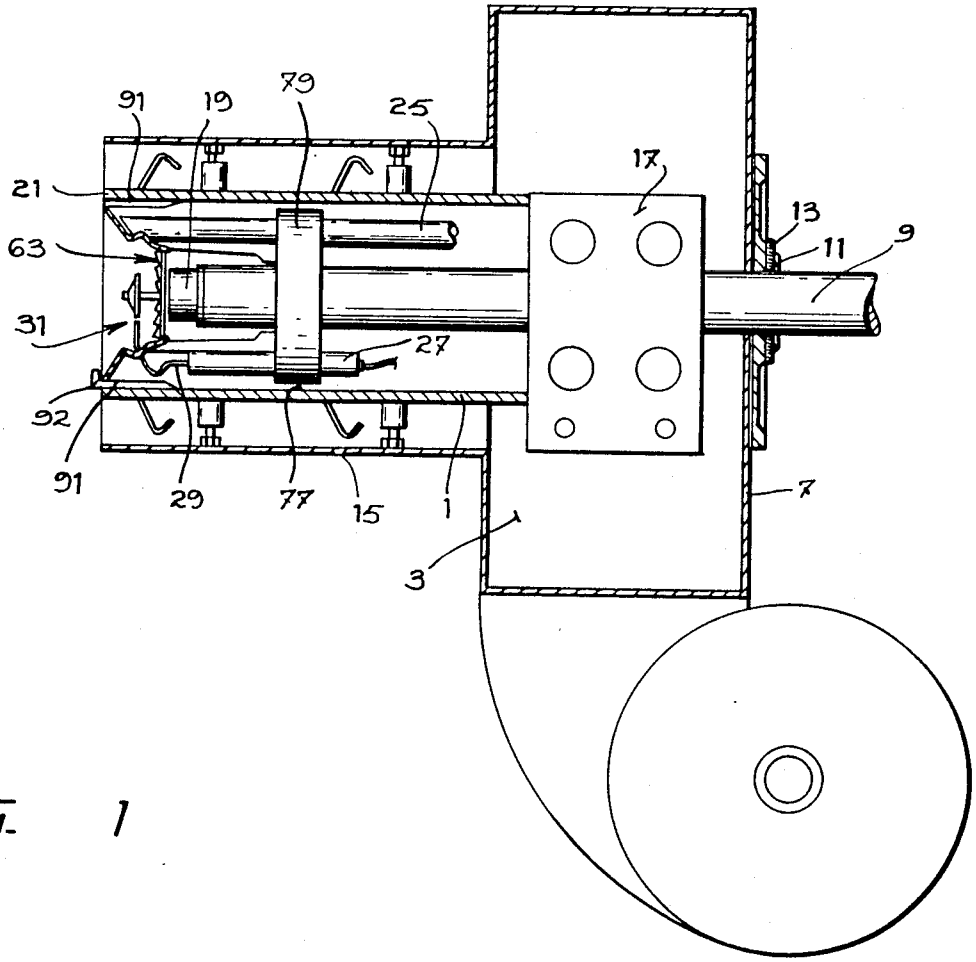
FIG. 1 is a longitudinal cross-sectional view of a burner assembly, using oil as fuel, and incorporating the improved flame retention head assembly with a disc-shaped deflector according to the present invention.

The burner assembly according to the invention as shown in the appended drawings, comprises a cylindrical air supply pipe 1 rigidly mounted inside an insulated sleeve 15. The pipe 1 has one of its ends 17 provided with a set of radial apertures adjustable in size by means of a sleeve. This apertured end 17 extends in an air plenum chamber 3 which is connected to the outlet of a blower 5 and closed by a radial wall 7 apertured at the center to allow for the passage of a gas nozzle 9 supported by a collar 11 solid with the radial wall 7. The purpose of the apertured end 17 is to neutralize turbulences of the incoming combustion air and thus to provide an outcoming axial air flow. The gas nozzle 9 can be secured onto the collar 11 by screws 13 or any other suitable means. This gas nozzle is provided with an inlet end (not shown) located outside the plenum chamber 3 and with an outlet end 19 located inside the air pipe 1 close to the outlet end 21 of this air pipe. The inlet end of the gas nozzle laying outside the assembly is connected to a gas supply (not shown) in any conventional manner.

In accordance with the invention, a flame retention head 31 is mounted concentrically within the air pipe 1 in front of the outlet end 19 of the gas nozzle 9. This head 31 can be provided with a known combustion-promoting catalytic screen, secured thereto in any known manner. This screen may be made, as is known, of nickel oxide, platinum and/or palladium. It is used only on gas-fuel burner assembly.

As shown in greater details in FIG. 2, the outlet 19 of the gas nozzle 9 is cylindrical in shape and closed by a transversal wall 37 provided with a plurality of circumferentially spaced openings 39 altogether defining a gas discharge orifice or mouth 41.

As aforesaid, the flame retention head 31 is mounted at a short distance in front of the gas discharge orifice. The head 31 is an outwardly diverging member preferably made in one piece with an internal, continuously curved contour as shown in the drawings.

According to the invention, this head comprises four different sections extending successively one after each other. These section are the followings:

a substantially cylindrical section 43 having a diameter greater than the diameter of the outlet end 19 of gas nozzle 9, and defining an air-and-fuel mixture chamber 45;

a first outwardly flaring section 47 continuously extending the cylindrical section 43, this section 47 defining a first expansion chamber 53;

an inwardly flaring section 49 continuously extending the first outwardly flaring section 47, this inwardly flaring section defining a throttle 54 with a diameter greater than the diameter of the cylindrical section 43, downstream the first expansion chamber 53, and a second outwardly flaring section 55 continuously extending the inwardly flaring section 49, this second outwardly flaring section being preferably parabolic in cross section and defining a second expansion chamber 57.

Thus, and as aforesaid, the head 31 comprises two expansion chambers 53, 57 separated by a throttle 54 to provide an improved combustion and flame pattern control.

Figure 4:
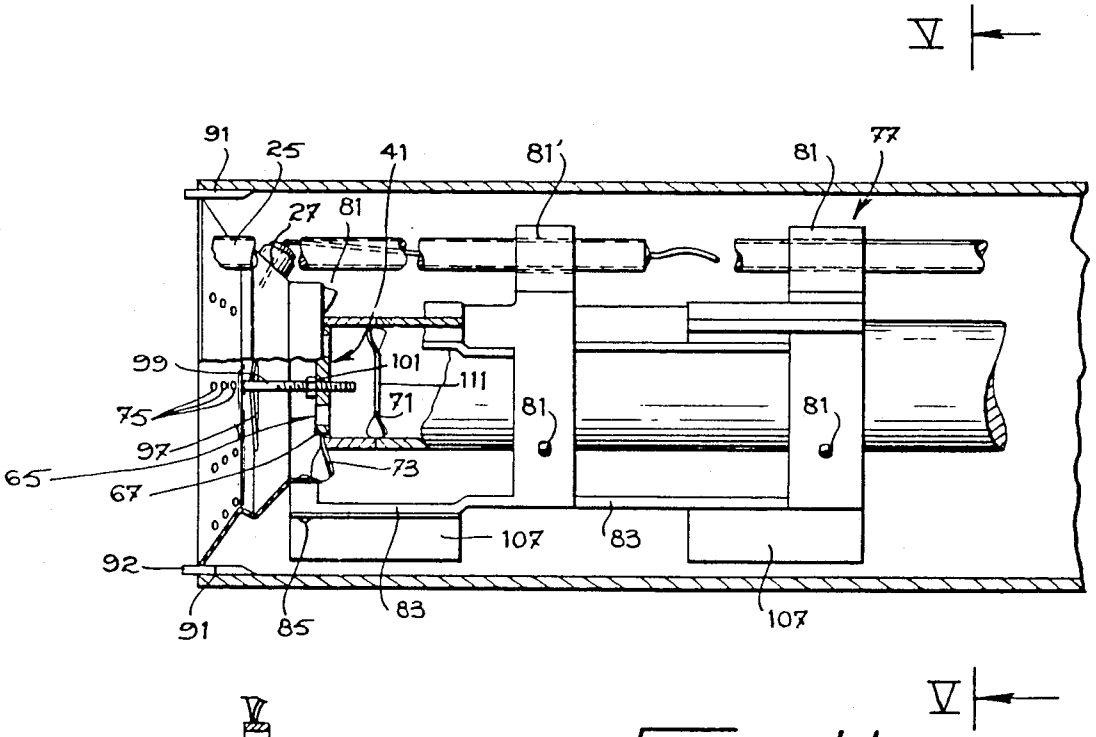
FIG. 4 is a longitudinal cross-sectional view similar to that of FIG. 2 but showing another burner assembly according to the invention, using gas as fuel.
Figure 4A:
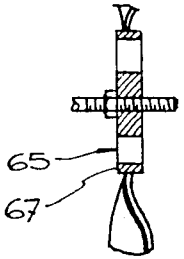
FIG. 4A is a partial enlarged section of FIG. 4.
Figure 6:
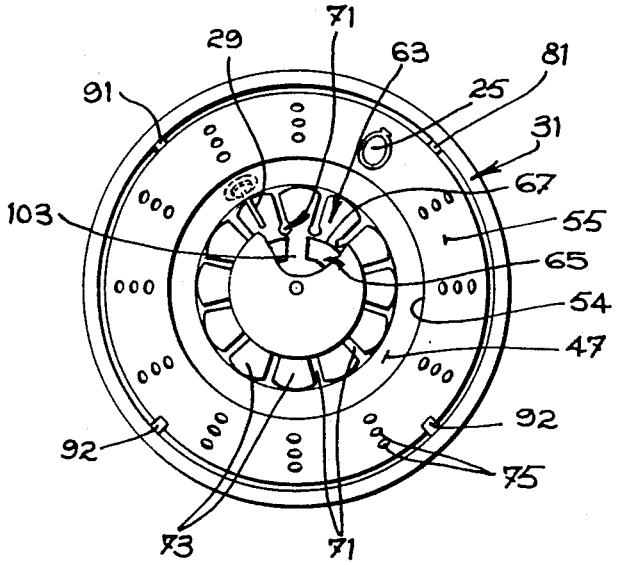
FIG. 6 is a front view of the burner assembly of FIG. 4.

As possibly best seen in FIGS. 2, 4 and 6, the head 31 supports a spinner plate 63 mounted transversally across the inlet end of the cylindrical section 43. This plate 63 comprises a cylindrical ring 67 defining a central hole 65 (see FIG. 4) having a diameter substantially identical to the diameter of the mouth 41 of the nozzle 9. The ring 67 is extended by a plurality of blades 73, preferably twelve, regularly distributed around it to cause air to enter and swirl into the mixture chamber 45 through the annular space defined between the peripheries of the fuel nozzle 9 and of the cylindrical section 43 of the retention head, respectively. The blades 73 may be obtained by twisting peripheral portions of a flat annulus welded to the ring 67, about a plurality of radial axes located in the plane of the annulus as is known. The spinner plate 63 is fixed to the first cylindrical section 43 of the head 31 through its blades 73. While the mixing chamber 45 may appear in the drawings as slightly conical for accommodating the blades 73, it may be considered as essentially cylindrical.

Because of the particular shape of the blades 73 and the ensuing shape of the apertures 71 defined therebetween, it will be understood that air swirling into the mixing chamber 45 is greatly perturbed, thereby promoting an efficient mixture with the fuel discharged by the nozzle 9 through the central hole 65 of the spinner plate 63.

To sustain combustion in the second expansion chamber 57, the second outwardly flaring section 55 is provided with a plurality of circumferentially-spaced, air apertures 75 opening within the air pipe 1 so as to allow air to pass into the retention head. Advantageously, the air-apertures 75 are arranged in rows extending in radial planes equally spaced apart all around the retention head. Each row may comprise three holes, as shown in the drawings.

As aforesaid, the retention head 31 is mounted concentrically within the air pipe 1 at a short distance in front of the outlet end 19 of the gas nozzle 19. To do so, a retention head holder 77 may be used, as shown in FIGS. 1, 2 and 4.

Figure 5:
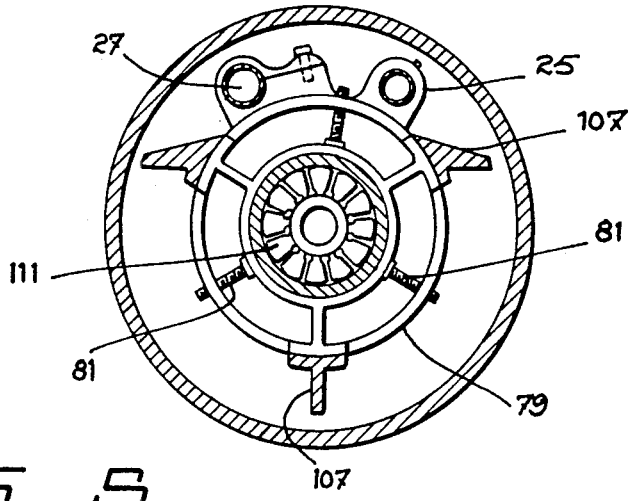
FIG. 5 is a cross-sectional view along line V—V of FIG. 4.

The retention head holder 77 comprises two or more holding arms 83 each having one end connected to the retention head 31, by means of rivets or bolts 85 passing through the wall of the cylindrical section 43. The other ends of the arms are connected to at least one positioning ring 79 coaxially mounted onto the fuel nozzle 9. If desired, two rings may be used as shown in FIG. 4, to provide a better fixation for the arms 83 and head 31 fixed thereto. Each ring 79 is fixed onto the nozzle 9 by means of a set of adjustable screws 81 circumferentially distributed around the nozzle to permit positioning and central adjustment of the holder 77 and head 31 fixed thereto, with respect to the nozzle. The screws may pass through the ring(s) as shown in FIGS. 4 and 5 or through the body of the holding arms 83 as shown in FIGS. 1 and 2.

As can be understood, the distance between the mouth 41 of the fuel nozzle 9 and the head and spinner plate assembly may be easily adjusted, corrected or modified by mere translation of the holder 77 along the nozzle 9. Determination of the distance which corresponds to a maximum efficiency of the burner, usually has to be made on the premises, since it depends on numerous factors (type of fuel, pressures of the air and fuel discharges, desired Burner operation, . . . ). In practice, this distance may range between 1/16 and ½ inch. In addition of being supported by the holder 77 at one end, the head and spinner plate assembly may also be supported and guided at the other end by means of a plurality of elongated ribs 91 that extend longitudinally and radially inwardly all around the outlet end of the air pipe 1. These ribs 91 that are preferably evenly spaced circumferentially around the outlet of the pipe 1 are meant to hold in centered position and laterally guide the outer end of the second outwardly flaring section 55 of the head 31 when this head and the spinner plate 63 are axially adjusted with respect to the nozzle mouth 41. Three or four ribs 91 will usually be found sufficient. If desired, the end of one or more ribs 91 may be bent to form a retaining hook 92 to prevent the head 31 from being pushed forward too far. In addition to centering the head 31, the ribs 91 hold the periphery of the outlet section 55 of the head 31 spaced apart from the inner surface of the air pipe 1, thereby leaving outlet passages for air, between the ribs and thus peripherical air supply all around the outer end of the head 31.

In addition to the retention head 31 and the spinner plate 63, the retention head assembly according to the invention further comprises a round shaped deflector mounted concentrically within the retention head 31, so as to extend transversally across said retention head 31 thereby causing the air and fuel mixture entering the head through the inlet end of the cylindrical section 43, to stay longer within the first or second expansion chamber 45.

In the particular embodiments of the invention shown in FIGS. 1 to 6, the round-shaped deflector consists of a disc 97 which extends transversally and coaxially in the center of the retention head. Due to its central position, the disc 97 "stops" the fuel outcoming from the nozzle mouth 41 and deflects it back to the combustion and first expansion chambers, thereby causing greater turbulences inside the expansion chamber 45 and substantially improved mingling of the fuel with the turbulent air coming through the spinner plate 63 across the inlet apertures 71 provided therein.

As better shown in FIGS. 2, 3, 4 and 6, the disc 97 is fixed to the end of a threaded rod 99 screwed either in a nut 101 supported by a small bracket 103 in the middle of the central hole 65 of the spinner plate 63 (see FIGS. 4 and 6), or in a threaded hole 105 provided in the middle of the transversal wall 37, if any, closing the mouth 41 of the gas nozzle (see FIGS. 2 and 3). It will be understood that rotation of the threaded rod 99 in the nut 101 or in the threaded hole 105 permits to adjust the position of the pre-mix disc 97 with respect to the discharge mouth 41 of the nozzle 9 and thus to adjust the amount of turbulences created by the disc, which turbulences cause a better mixture of the air and fuel within the first expansion chamber 45 and a longer stay of this mixture inside said chamber 45. Preferably, the disc 97 will be adjusted to a position where it extends transversally across the head 31 at the outlet of the first expansion chamber 45, which outlet extends in the plane from which starts the inwardly flaring section 49.

As also shown in FIGS. 1 to 6 of the drawings, the disc 97 preferably has a diameter equal to or greater than the diameter of the central hole 65 of the spinner plate 63 to achieve better deflection of the fuel injection inside the first expansion chamber 41. Advantageously, this diameter will be selected so that the surface of the disc 98 is about 10 to 30% greater than the surface of the central hole 65 of the spinner plate 63.

In the other embodiment of the invention shown in FIG. 7, the round-shaped deflector mounted concentrically within the retention head 31 consists of a cone 197 which extends transversally and coaxially in the centre of the retention head. This cone has its round-shaped base 198 transversally extending across the head substantially in the plane from which extends the inwardly flaring section 49 and its tip extending upstream close to the center of the spinner plate 63. Due to its particular position, the cone 197 cooperates with the throttle 54 defined by the inwardly flaring section 49 to form a Venturi-like nozzle in which the mixture of air and fuel formed in the mixture and first expansion chambers 45 and 53 respectively is first accelerated and subsequently deflected with great turbulences into the second expansion chamber 57 in the zone located downstream the base 198 of the cone 197.

The so generated turbulences further improve the mixture of the air and fuel within the head 31 in addition of causing a longer stay of this mixture inside the second chamber 45.

The diameter base of the cone 192 may vary depending on the input and speed of the gas and air mixture supply. Thus, it may be smaller or greater than or identical to the diameter of the central hole 65 of the spinner plate 63.

The cone 197 is advantageously mounted within the head 31 in the same manner as the disc 97, using a projecting threated rod 199 at the tip of the cone.

If desired, the cone 197 may be provided with fins 200 as shown in FIG. 8 to further increase the turbulences.

The retention head holder 77 mentioned hereinabove may be used for supporting a flame detector 25 of conventional structure, capable of shutting off the installation in the absence of any flame in the retention head 31, and an electric fuel ignitor 27 with an electrode 29 entering into the retention head. As shown in the drawings, the fuel ignitor 27 is advantabeously positioned so as to ignite the air-and-fuel mixture close to the periphery of the pre-mix disc 97 by creation of an electrical arc between the electrode 29 and the disc 97. This particular mode of ignition is particularly interesting in that it allows direct ignition of the fuel and air mixture, without necessity of other lighting devices such as a pilot burner. On the other hand, the flame detector 25 is positioned so as to detect the flame within the second expansion chamber 57, through a hole provided in the section 55.

The retention head holder may further be provided with fins 107 as shown in FIGS. 4 and 5. These fins are particularly interesting in that they stabilize the air within the air pipe 1 before it reaches the retention head 31.

Within the above description in mind, it will be understood that pressure air supplied by the blower 5 and entering into the plenum chamber 3 may be said to divide itself, from thereon, into three different air streams. The main air-stream, located centrally and around the nozzle 9, enters through the apertures 71 of the spinner plate 63 into the mixing chamber 45 while being violently swirled. In this chamber 45, it abruptly meets and mixes with the fuel discharged through the nozzle 9 so that a very efficient first mixing of fuel and air takes place.

Immediately thereafter, the fuel and air mixture is subjected to a sudden expansion in the chamber 53 and to a further mixing due to the turbulences created by the disc 97 or cone 197. This expansion in the chamber 53 is immediately followed by a contraction of the mixture flow after it has been ignited, in the throttle chamber 54 before being again expanded in the second expansion chamber 57 formed by the parabolic section 55. In that area, a second stream of air exits through the apertures 75 to sustain combustion, control the pattern of the flame and cool the relevant section of the head 31. These functions are assisted by a third stream of air which flow along the inner periphery of the pipe 1.

Tests carried out by the inventor have shown that in order to stabilize the flame and thus prevent "lift off" of this flame in use, the ratio (Ap/As) of the amount of primary air (Ap) supplied through the apertures of the spinner plate 63 (main air stream) to the amount of secondary air (As) supplied through the apertures 75 of the second expansion chamber 57 (second air stream) must be smaller than 2. These tests have also shown that the best combustion rate are obtained when the ratio Ap/As is equal to or smaller than 1.4.

The burner assemblies of FIGS. 1 to 3 and 6 is intended to be used with gas. This assembly in which the structure of the nozzle mouth 41 is as shown in FIGS. 1 to 3, does not necessitate any catalytic screen.

In the embodiment illustrated in FIGS. 4 to 6, gas is used as fuel. In this case, the flame retention and pattern control head 31 has exactly the same shape as the one shown in FIGS. 1 to 3 except that it further comprises an additional spinner plate 111 mounted transversally within the fuel nozzle 9 at a short distance from the open, outlet end 41 of this nozzle. This additional spinner plate 111 is structurally identical to the plate 63 mounted transversally across the inlet end of the cylindrical section 43 of the retention head 31, and thus comprises a set of peripherical blades (preferably twelve), of which the function is to convert part of the static energy of the gas, namely its pressure, into kinetic energy. The plate 111 also comprises a central hole of which the diameter is selected according the requested gas discharge for a predetermined heat requirement. The following table will give two examples of possible diameters.

TABLE

| Heat Requirement | Diameter of the central hole |
|---|---|
| 2 to 4 MBTU/h | 5/16" |
| 5 to 7 MBTU/h | 9/16" |

The embodiments of the invention in which an exclusive property or privilege is claimed are defined as follows:

1. A flame retention head assembly for use in a fuel burner having a fuel nozzle mounted coaxially within an air pipe, said head assembly comprising:

(a) a continuously contoured, outwardly diverging retention head adapted to be mounted concentricaly within the air pipe in front of the fuel nozzle, said retention head comprising:

a substantially cylindrical section having a diameter greater than the diameter of the fuel nozzle, and an inlet end intended to be located at a short distance ahead of the fuel nozzle, said cylindrical section defining an air-and-fuel mixture chamber;

a first outwardly flaring section continuously extending the cylindrical section, said outwardly flaring section defining a first expansion chamber;

an inwardly flaring section continuously extending the first outwardly flaring section, said inwardly flaring section defining a throttle with a diameter greater than the diameter of the cylindrical section, downstream the first expansion chamber, and a second outwardly flaring section continuously extending the inwardly flaring section, said second outwardly flaring section defining a second expansion chamber;

(b) a spinner plate mounted transversally across the inlet end of the cylindrical section of the retention head, said spinner plate defining a primary air inlet and comprising:

a central ring provided with a central hole, said central hole having a diameter substantially identical to the diameter of the fuel nozzle; and a plurality of blades regularly distributed around said ring to cause air to enter and swirl into the mixture chamber through the annular space defined between the peripheries of said fuel nozzle and the cylindrical section of the retention head respectively, said swirling air mixing within said mixture chamber with the fuel discharged therein by the fuel nozzle through the central hole of the spinner-plate;

(c) a plurality of circumferentially-spaced, air apertures provided exclusively through the second outwardly flaring section of the retention head, said apertures being intended to be in communication with the air pipe to allow air to pass into the second expansion chamber to sustain combustion therein; and (d) a round-shaped deflector having a flat planar surface mounted concentrically within the retention head, said deflector extending transversally across said retention head to cause the air and fuel entering said head through the inlet end of the cylindrical section to stay longer within the first expansion chamber and to induce a controlled recirculation of the mixture downstream the deflector into the second expansion chamber, wherein said round-shaped deflector is a disc having a diameter equal to or greater than the diameter of the central hole of the spinner plate.

2. A head assemly as claimed in claim 1, wherein the diameter of the disc is selected so that the surface of said disc be about 10 to 30% greater than the surface of the central hole of the spinner plate.

3. A head assembly as claimed in claim 1, wherein the disc is mounted within the retention head so as to transversally extend across said head in the plane from which extends the inwardly flaring section.

4. A head assembly as claimed in claim 1, wherein the disc is fixed to one end of a threaded rod screwed in a nut mounted in the middle of the central hole of the spinner plate.

5. A head assembly as claimed in claim 4, wherein:

the second outwardly flaring section is parabolic in cross-section, and the air-apertures provided therethrough are arranged in rows extending in radial planes equally spaced apart all around the retention head.

6. A flame retention head assembly for use in a fuel burner having a fuel nozzle mounted coaxially within an air pipe, said head assembly comprising:

(a) a continuously contoured, outwardly diverging retention head adapted to be mounted concentrically within the air pipe in front of the fuel nozzle, said retention head comprising:

a substantially cylindrical section having a diameter greater than the diameter of the fuel nozzle, and an inlet end intended to be located at a short distance ahead of the fuel nozzle, said cylindrical section defining an air-and-fuel mixture chamber;

a first outwardly flaring section continuously extending the cylindrical section, said outwardly flaring section defining a first expansion chamber;

an inwardly flaring section continuously extending the first outwardly flaring section, said inwardly flaring section defining a throttle with a diameter greater than the diameter of the cylindrical section, downstream the first expansion chamber, and a second outwardly flaring section continuously extending the inwardly flaring section, said section outwardly flaring section defining a second expansion chamber;

(b) a spinner plate mounted transversally across the inlet end of the cylindrical section of the retention head, said spinner plate defining a primary air inlet and comprising:

a central ring provided with a central hole, said central hole having a diameter substantially identical to the diameter of the fuel nozzle; and a plurality of blades regularly distributed around said ring to cause air to enter and swirl into the mixture chamber through the annular space defined between the peripheries of said fuel nozzle and the cylindrical section of the retention head respectively, said swirling air mixing within said mixture chamber with the fuel discharged therein by the fuel nozzle through the central hole of the spinner-plate;

(c) a plurality of circumferentially-spaced, air apertures provided exclusively through the second outwardly flaring section of the retention head, said apertures being intended to be in communication with the air pipe to allow air to pass into the second expansion chamber to sustain combustion therein; and (d) a round-shaped deflector having a flat planar surface mounted concentrically within the retention head, said deflector extending transversally across said retention head to cause the air and fuel entering said head through the inlet end of the cylindrical section to stay longer within the first expansion chamber and to induce a controlled recirculation of the mixture downstream the deflector into the second expansion chamber, wherein said round-shaped deflector is a cone.

7. A head assembly as claimed in claim 6, wherein the cone is coaxially mounted within the retention head, said cone having a base transversally extending across said head substantially in the plane from which extends the inwardly flaring section and a tip extruding upstream close to the center of the spinner plate.

8. A head assembly as claimed in claim 7, wherein the cone is fixed by its tip to one end of a threaded rod screwed in a nut mounted in the middle of the central hole of the spinner plate.

9. A head assembly as claimed in claim 8, wherein:

the second outwardly flaring section is parabolic in cross-section, and the air-apertures provided therethrough are arranged in rows extending in radial planes equally spaced apart all around the retention head.

10. A fuel burner assembly comprising:

(a) an air pipe having an inlet end intended to be connected to an air supply, and an outlet end;

(b) a fuel burner comprising a fuel nozzle having an inlet end intended to be connected to a fuel supply and an outlet end, and means for mounting said nozzle concentrically within said air pipe, close to its outlet end;

(c) a continuously contoured outwardly diverging retention head and means for mounting said retention head concentrically within said air pipe in front of said air nozzle, said retention head comprising:

a substantially cylindrical section having a diameter greater than the diameter of the fuel nozzle, and an inlet end located at a short distance ahead of the fuel nozzle, said cylindrical section defining an air-and-fuel mixture chamber;

a first outwardly flaring section continuously extending the cylindrical section, said outwardly flaring section defining a first expansion chamber;

an inwardly flaring section continuously extending the first outwardly flaring section, said inwardly flaring section defining a throttle with a diameter greater than the diameter of the cylindrical section, downstream the first expansion chamber, and a second outwardly flaring section continuously extending the inwardly flaring section, said second outwardly flaring section being parabolic in cross-section and defining a second expansion chamber;

(d) a spinner plate mounted transversally across the inlet end of the cylindrical section of the retention head, a central ring provided with a central hole, said central hole having a diameter substantially identical to the diameter of the fuel nozzle; and a plurality of blades regularly distributed around said ring to cause air to enter and swirl into the mixture chamber through the annular space defined between the peripheries of said fuel nozzle and the cylindrical section of the retention head respectively, said swirling air mixing within said mixture chamber with the fuel discharged therein by the fuel nozzle through the central hole of the spinner-plate;

(e) a plurality of circumferentially-spaced, air apertures provided exclusively through the second outwardly flaring section of the retention head, said apertures being in direct communication with the air pipe so as to allow air to pass into the second combustion chamber to sustain combustion therein; and (f) a round-shaped, plain-surfaced deflector mounted concentrically within the retention head, said deflector extending transversally across said retention head to cause the air and fuel entering said head through the inlet end of the cylindrical section, to stay longer within the first or second expansion chamber, wherein said round-shaped deflector is a disc with a flat planar surface and having a diameter equal to or greater than the diameter of the central hole of the spinner plate, said disc being mounted so as to transversally extend across said head in the plane from which extends the inwardly flaring section.

11. A fuel burner as claimed in claim 10, wherein the round-shaped deflector is fixed to one end of a threaded rod adjustable in length with respect to the spinner plate.

12. A fuel burner as claimed in claim 11, wherein the threaded rod is screwed on a nut fixed onto a support in the middle of the central hole of the spinner plate.

13. A fuel burner as claimed in claim 11, wherein the threaded rod is screwed on a nut fixed onto a support in the middle of the outlet end of the fuel nozzle.

14. A fuel burner assembly comprising:

(a) an air pipe having an inlet end intended to be connected to an air supply, and an outlet end;

(b) a fuel burner comprising a fuel nozzle having an inlet end intended to be connected to a fuel supply and an outlet end, and means for mounting said nozzle concentrically within said air pipe, close to its outlet end;

(c) a continuously contoured outwardly diverging retention head and means for mounting said retention head concentrically within said air pipe in front of said air nozzle, said retention head comprising:

a substantially cylindrical section having a diameter greater than the diameter of the fuel nozzle, and an inlet end located at a short distance ahead of the fuel nozzle, said cylindrical section defining an air-and-fuel mixture chamber;

a first outwardly flaring section continuously extending the cylindrical section, said outwardly flaring section defining a first expansion chamber;

an inwardly flaring section continuously extending the first outwardly flaring section, said inwardly flaring section defining a throttle with a diameter greater than the diameter of the cylindrical section, downstream the first expansion chamber, and a second outwardly flaring section continuously extending the inwardly flaring section, said second outwardly flaring section being parabolic in cross-section and defining a second expansion chamber;

(d) a spinner plate mounted tranversaly across the inlet end of the cylindrical section of the retention head, said spinner plate defining a primary air inlet and comprising:

a central ring provided with a central hole, said central hole having a diameter substantially identical to the diameter of the fuel nozzle; and a plurality of blades regularly distributed around said ring to cause air to enter and swirl into the mixture chamber through the annular space defined between the peripheris of said fuel nozzle and the cylindrical section of the retention head respectively, said swirling air mixing within said mixture chamber with the fuel discharged therein by the fuel nozzle through the central hole of the spinner plate;

(e) a plurality of circumferentially-shaped, air apertures provided exclusively through the second outwardly flaring section of the retention head, said apertures being in direct communication with the air pipe so as to pass into the second combustion chamber to sustain combustion therein;

(f) a round-shaped deflector having a flat planar surface mounted concentrically within the retention head, said deflector being fixed to one end of a threaded rod adjustable in length with respect to the spinner plate so as to extend transversally across said retention head to cause the air and fuel entering said head through the inlet end of the cylindrical section, to stay longer within the first or second expansion chamber, and (g) an additional spinner plate mounted transversally within the fuel nozzle at a short distance from its outlet end.

15. A fuel burner assembly comprising:

(a) an air pipe having an inlet end intended to be connected to an air supply, and an outlet end;

(b) a fuel burner comprising a fuel nozzle having an inlet end intended to be connected to a fuel supply and an outlet end, and means for mounting said nozzle concentrically within said air pipe, close to its outlet end;

(c) a continuously contoured outwardly diverging retention head and means for mounting said retention head concentrically within said air pipe in front of said air nozzle, said retention head comprising:

a substantially cylindrical section having a diameter greater than the diameter of the fuel nozzle and an inlet end located at a short distance ahead of the fuel nozzle, said cylindrical section defining an air-and-fuel mixture chamber;

a first outwardly flaring section continuously extending the cylindrical section, said outwardly flaring section defining a first expansion chamber;

an inwardly flaring section continuously extending the first outwardly flaring section, said inwardly flaring section defining a throttle with a diameter greater than the diameter of the cylindrical section, downstream the first expansion chamber, and a second outwardly flaring section continuously extending the inwardly flaring section, said second outwardly flaring section being parabolic in cross-section and defining a second expansion chamber;

(d) a spinner plate mounted transversally across the inlet end of the cylindrical section of the retention head, said spinner plate defining a primary air inlet and comprising:

a central ring provided with a central hole, said central hole having a diameter substantially identical to the diameter of the fuel nozzle; and a plurality of blades regularly distributed around said ring to cause air to enter and swirl into the mixture chamber through the annular space defined between the peripheries of said fuel nozzle and the cylindrical section of the retention head respectively, said swirling air mixing within said mixture chamber with the fuel discharged therein by the fuel nozzle through the central hole of the spinner-plate;

(e) a plurality of circumferentially-shaped, air apertures provided exclusively through the second outwardly flaring section of the retention head, said apertures being direct communication with the air pipe so as to allow air to pass into the second combustion chamber to sustain combustion therein;

(f) a round-shaped deflector having a flat planar surface mounted concentrically within the retention head, said deflector being fixed to one end of a threaded rod adjustable in length with respect to the spinner plate so as to extend transversally across said retention head to cause the air and fuel entering said head through the inlet end of the cylindrical section, to stay longer within the first or second expansion chamber, wherein said means for mounting the retention head concentrically within said air pipe in front of the fuel nozzle comprises a retention head holder comprising:

at least one ring externally mounted around the fuel nozzle;

at least one arm rigidly connecting the retention head to the said at least one ring; and a set of adjustable screws for centering and simultaneously fixing said at least one ring with respect to the fuel nozzle.

16. A fuel burner as claimed in claim 15, wherein said means for mounting the retention head further comprises elongated ribs extending longitudinally and radially inwardly all around the outlet end of the air pipe, for laterally holding the outer end of the second outwardly flaring section of the retention head in centered position and spaced apart relation with respect to said air pipe, and simultaneously allowing peripherical air supply all around the outer end of said retention head.

17. A fuel burner as claimed in claim 16, further comprising a fuel ignitor and a flame detector mounted onto the retention head holder.

18. A fuel burner as claimed in claim 17, wherein:

the fuel ignitor is positioned so as to ignite the air-and-fuel mixture close to the periphery of the round-shaped deflector; and the flame detector is positioned so as to detect the flame within one of the said expansion chambers.

19. A fuel burner as claimed in claim 18, further comprising fins mounted onto the retention head holder for stabilizing air within the air pipe before said air reaches the retention head.

20. A fuel burner as claimed in claim 18, wherein the air-apertures provided through the second outwardly flaring section of the retention head are arranged in rows extending in radial planes equally spaced apart all around the retention head.

21. A fuel burner as claimed in claim 18, wherein the fuel supply is a gas-supply.

22. A fuel burner assembly comprising:

(a) an air pipe having an inlet end intended to be connected to an air supply, and an outlet end;

(b) a fuel burner comprising a fuel nozzle having an inlet end intended to be connected to a fuel supply and an outlet end, and means for mounting said nozzle concentrically within said air pipe, close to its outlet end;

(c) a continuously contoured outwardly diverging retention head and means for mounting said retention head concentrically within said air pipe in front of said air nozzle, said retention head comprising:

a substantially cylindrical section having a diameter greater than the diameter of the fuel nozzle, and an inlet end located at a short distance ahead of the fuel nozzle, said cylindrical section defining an air-and-fuel mixture chamber;

a first outwardly flaring section continuously extending the cylindrical section, said outwardly flaring section defining a first expansion chamber;

an inwardly flaring section continuously extending the first outwardly flaring section, said inwardly flaring section defining a throttle with a diameter greater than the diameter of the cylindrical section, downstream the first expansion chamber, and a second outwardly flaring section continuously extending the inwardly flaring section, said second outwardly flaring section being parabolic in cross-section and defining a second expansion chamber;

(d) a spinner plate mounted transversally across the inlet end of the cylindrical section of the retention head, said spinner plate defining a primary air inlet and comprising:

a central ring provided with a central hole, said central hole having a diameter substantially identical to the diameter of the fuel nozzle; and a plurality of blades regularly distributed around said ring to cause air to enter and swirl into the mixture chamber through the annular spaced defined between the peripheries of said fuel nozzle and the cylindrical section of the retention head respectively, said swirling air mixing within said mixture chamber with the fuel discharged therein by the fuel nozzle through the central hole of the spinner-plate;

(e) a plurality of circumferentially-spaced air apertures provided exclusively through the second outwardly flaring section of the retention head, said apertures being in direct communication with the air pipe so as to allow air to pass into the second combustion chamber to sustain combustion therein;

(f) a round-shaped, plain-surfaced deflector mounted concentrically within the retention head, said deflector being fixed to one end of a threaded rod adjustable in length with respect to the spinner plate so as to extend transversally across said retention head to cause the air and fuel entering said head through the inlet end of the cylindrical section, to stay longer within the first or second expansion chamber, wherein the round-shaped deflector is a cone coaxially mounted within the retention head, said cone having a base transversally extending across said head substantially in the plane from which extends the inwardly flaring section and a tip extending upstream close to the center of the spinner plate.

* * * * *

UNITED STATES PATENT AND TRADEMARK OFFICE

CERTIFICATE OF CORRECTION

PATENT NO. : 4,643,672

DATED : February 17, 1987

INVENTOR(S) : Denis LEFEBVRE

It is certified that error appears in the above-identified patent and that said Letters Patent is hereby corrected as shown below:

IN THE SPECIFICATION:

Column 3, line 68: the word "oil" should read --gas--.

Signed and Sealed this

Seventeenth Day of November, 1987

*Attest:*

DONALD J. QUIGG

*Attesting Officer*

*Commissioner of Patents and Trademarks*